United States Patent [19]

Sasaki et al.

[11] Patent Number: 4,712,605

[45] Date of Patent: Dec. 15, 1987

[54] PROCESS FOR PRODUCING HOLLOW CAST ARTICLE

[75] Inventors: Nobuyoshi Sasaki; Susumu Baba; Hisahiro Arai, all of Yokohama, Japan

[73] Assignee: M.C.L. Co., Ltd., Japan

[21] Appl. No.: 2,006

[22] Filed: Jan. 12, 1987

[30] Foreign Application Priority Data

Jan. 27, 1986 [JP] Japan ..... 61-13871

[51] Int. Cl.[4] ..... B22C 9/04; B22D 19/16

[52] U.S. Cl. ..... 164/516; 164/34; 164/35; 164/45; 164/46; 164/95; 164/98

[58] Field of Search ..... 164/34–36, 164/46, 45, 132, 94, 95, 98, 361, 369, 516–519

[56] References Cited

U.S. PATENT DOCUMENTS 3,244,852 4/1966 Herterick et al. ..... 164/46 X

*Primary Examiner*—Kuang Y. Lin

*Attorney, Agent, or Firm*—Laff, Whitesel, Conte & Saret

[57] ABSTRACT

A process for producing a hollow metal cast product having a desired interior contour is provided. The process comprises the steps of preparing a first lost model having an outer contour substantially corresponding to a desired interior contour of the finished product, depositing a metallic or ceramic material or a mixture thereof over the surface of said first lost model by spraying to form a layer defining a hollow core block, placing said hollow core block in a first mold, pouring or injecting a material for forming a second lost mold into said first mold to form a second lost model, coating a refractory material over said second lost model to form a second mold for casting, removing second lost mold to form a cavity, casting a molten metal or alloy into said cavity, and staving said second mold to take out a finished product.

19 Claims, 3 Drawing Figures

PROCESS FOR PRODUCING HOLLOW CAST ARTICLE

BACKGROUND OF THE INVENTION

1. Field of the Invention

The present invention relates generally to a process for producing a cast article having a hollow cavity, and more particularly to a process for producing a hollow cast article having a desired interior contour defined by a very smooth inner wall surface.

2. Related Art Statement

A core mold has conventionally used in the prior art casting process for producing a hollow cast article having an interior cavity surrounded by a smooth inner wall surface, particularly when the interior cavity has a complicated contour. In case where it is desired that the cast product has an extremely smooth inner wall surface defining the interior cavity, a ceramic mold has been hitherto been used as the core mold. In general, such a core mold is prepared initially by molding a green core mold from a mixture of an aggregate, such as alumina or zirconia, and a binder, such as ethyl silicate, and then baking the green core mold. However, it is difficult to prepare a baked core mold of precise dimension, since the green material therefor tends to shrink or expand during the baking step to loose its dimensional stability. Other problems of the conventional ceramic core mold are that the quality thereof becomes often irregular and that the production efficiency thereof is inferior leading to high production cost.

OBJECT AND SUMMARY OF THE INVENTION

Accordingly, the principal object of this invention is to provide a process for producing a hollow metal cast product having an inner cavity surrounded by a smooth wall surface at a high production efficiency and at high dimensional stabilty.

Another object of this invention is to provide a hollow metal cast product without the use of a ceramic core mold which requires preliminary baking step.

Other objects and advantages of this invention will become apparent from the following detailed description.

According to the present invention, there is provided a process for producing a hollow metal cast product comprising the steps of preparing a first lost model having an outer contour substantially corresponding to a desired interior contour of the finished product, depositing a molten metal or alloy over the surface of said first lost model by spraying to form a metal layer defining a hollow core block, placing said hollow core block in a first mold, pouring or injecting a material for forming a second lost model into said first mold to form a second lost model layer, coating a refractory material over said second lost model layer to form a second mold for casting, removing said second lost model to form a cavity, casting a molten metal or alloy into said cavity, and staving said second mold to take out a finished product.

DESCRIPTION OF THE INVENTION

The present invention will now be described in detail with reference to preferred embodiments thereof.

Figure 1:
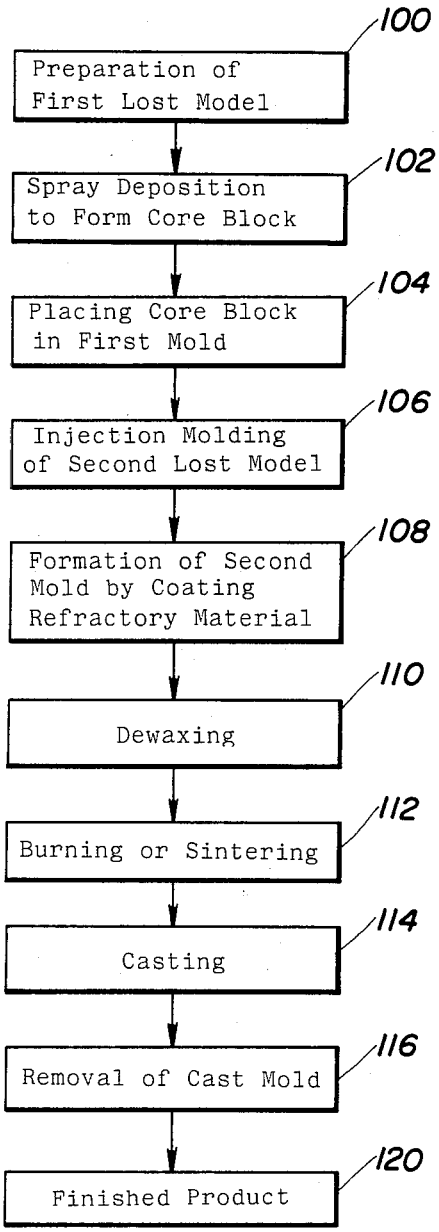
FIG. 1 is a flow diagram showing the successive steps of an embodiment of the process of this invention.
Figure 2:
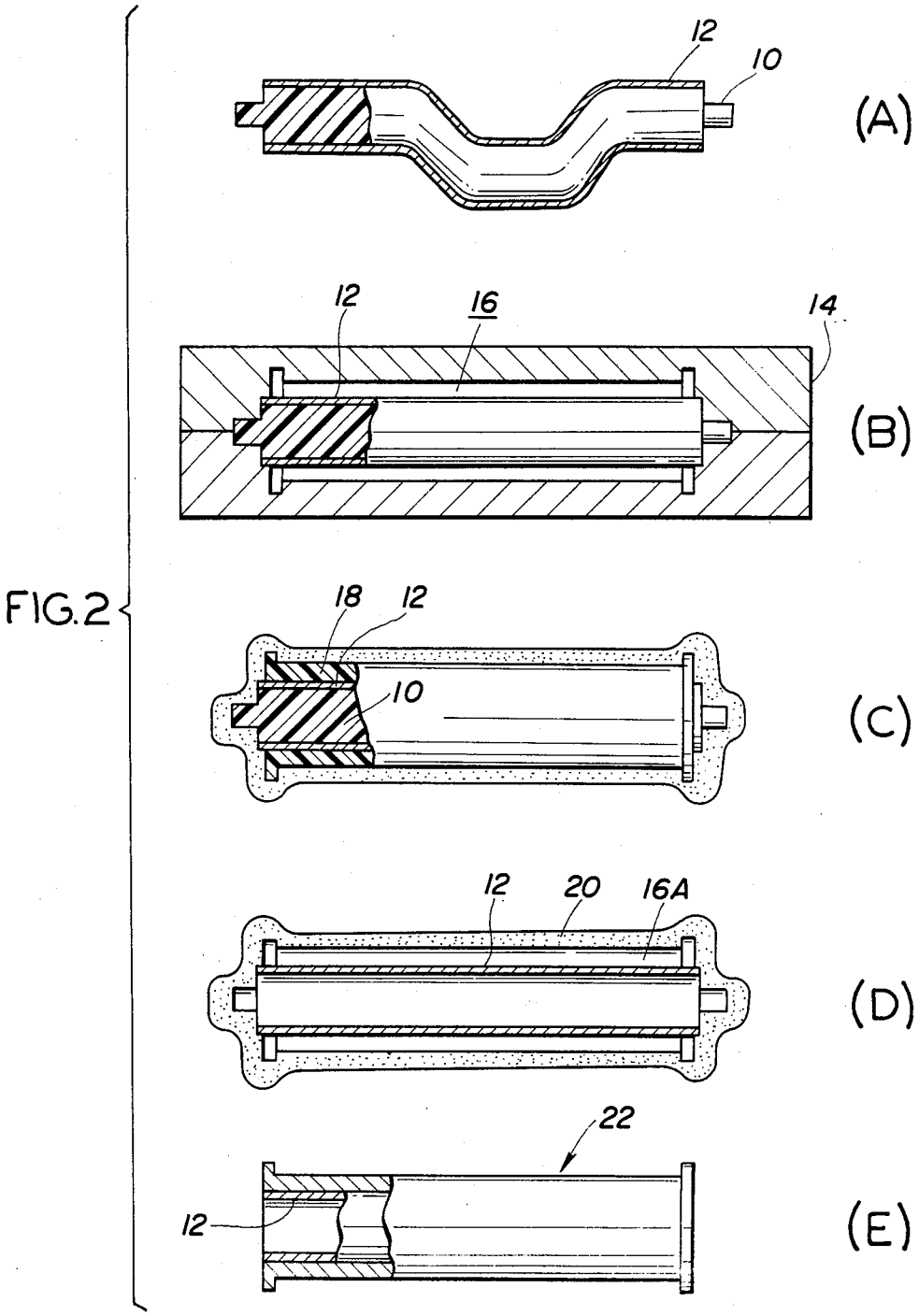
FIG. 2 is a schematic illustration showing the steps of the process of this invention.

Referring to FIGS. 1 and 2, prepared at the first step (step 100) is a first lost wax model 10 having an outer contour which is agreed with the desired interior contour of the finished cast product. This first lost wax model 10 may be molded by any known methods, such as an injection molding process, and may be made of a plastic material which may be melted by heating. Preferable examples of the material for the first lost wax model include natural and synthetic waxes such as paraffin wax and water-soluble waxes, and moldable synthetic resins such as polystyrene, urea resin and foamed polystyrene. The thus prepared first lost wax model is carried by a proper support to be ready for the next step.

The next step (step 102, see FIG. 2(A)) is the step of depositing a molten metallic material or ceramic material over the surface of the first lost wax model by spraying to form a metallic or ceramic layer 12. The metallic material used in this step is not particularly limited, and various metals and alloys may be used singly or in combination. Alternatively, the layer 12 may be made of a mixture of one or more metallic materials with one or more ceramic materials. When it is desired to form the layer 12 by two or more metallic and/or ceramic materials, a mixture may be sprayed onto the surface of the first lost wax model 10, or one of them is first sprayed onto the surface of the first lost wax model followed by successive spraying of the remaining metallic or ceramic materials to form a multi-plied coating.

The metallic or ceramic material may be deposited through a variety of spray-depositing methods. For example, when the layer 12 is made of a metallic material, a selected metal wire is melted by electric spark and blown by compressed air to be sprayed onto the surface of the first lost wax model. Alternatively, a selected metal wire is melted by high temperature flame and blown by compressed air to be sprayed onto the surface of the first lost wax model. In a further modified method, a metal powder or a mixture of metal powders is melted by high temperature flame and blown to be sprayed onto the surface of the first lost wax model. A so-called plasma metal spraying method may also be used in this step 102. It is desirous that either one of the molten metal spray gun or the first lost wax model is continuously moved to prevent a certain portion of the outer periphery of the lost wax model from being heated excessively by the applied molten metal to a temperature at which the lost wax model is melted.

This step 102 may also be carried out in an electric field to improve the effective use of the sprayed metallic material. In such a method, the first lost wax model 10 is made of an electrically conductive material or the surface thereof is coated with a conductive material. The first lost wax model may be electrically conductive, for example, by using a wax mixture containing a surfactant or emulsifier and water uniformly dispersed in a commercially available wax. The surface of the first lost wax model may be electrically conductive, for example, by coating a conductive material, such as a mixture of a surfactant and water. Then, a molten metallic material is sprayed out of the nozzle of a spray gun while a DC potential is applied between the gun and the surface of the first lost wax model. Whereupon, the fine particles or mists of molten metallic material are charged with electricity of one polarity and thus attracted by the first lost wax model 10 charged with electricity of the other polarity, so that the ratio or part of the blown metallic material particles wastefully consumed without depositing on the surface of the model 10 can be decreased, or in other words, to increase the ratio of the metallic material which has been effectively used to form the metallic coating or layer 12.

It is desirous that the molten metal spraying is implemented in an inert gas atmosphere when an easily oxidizable metal or alloy is used. For example, when a molten magnesium or titanium alloy is sprayed onto the surface of the first lost wax model, the molten alloy is sprayed in an inert gas atmosphere, such as argon gas atmosphere. It is preferred that the same inert gas as that used to form the inert gas atmosphere is used as the gas for blowing the molten metallic material from the spray gun.

Although a single metallic or ceramic material may be sprayed by a single step or a mixture of metallic and/or ceramic materials may be sprayed by a single step until a layer 12 having a desired thickness is formed, two or more different metallic or ceramic materials may be deposited through plural separate spraying steps so that a multi-plied coating or layer 12 having a desired thickness is formed.

In the next step (step 104, see FIG. 2(B)), the first lost wax model 10 applied with the coating or layer 12 is placed in position in a first mold 14. Then, a material for forming a second lost wax model is injected or otherwise filled in the cavity 16 defined between the layer 12 and the inner periphery of the first mold 14 (step 106). At this step 106, a second lost wax model 18 is molded so that it surrounds the outer surface of the spray-deposited layer 12. When the second lost wax model 18 is molded by an injection molding process, it is desired that a material for the second lost wax model 18 has a melting point which is lower than that of the wax material used for forming the first lost wax model 10 in order that the first lost wax model 10 is not melted during this step 106.

The composite model including the first and second lost wax models 10, 18 and the spray-deposited layer 12 is then coated with a refractory material, such as a ceramic material (step 108, see FIG. 2(C)). In detail, the composite model is dipped in a slurry container and then the thus wetted composited model is applied with stacco particles. The cycle of dipping in the slurry container and applying with stacco particles is repeated until the ceramic shell mold 20 has a desired thickness.

The next step (step 110) is a dewaxing step of heating to melt and remove the first and second lost wax models 10, 18. Then, the ceramic shell mold 20 is baked to obtain a baked ceramic shell mold (step 112, see FIG. 2(D)) in which the spray-deposited layer 12 is fixed in position.

In the next step (step 114), a molten metal is cast in the cavity 16A corresponding to the cavity 16 in the mold 14 and now defined by the inner periphery of the ceramic shell mold 20 and the spray-deposited layer 12. After cooling to solidify the cast metal, the shell mold 20 is removed (step 116).

Unnecessary portions are then cut away by machining to obtain a finished product 22, as denoted by 120 in FIG. 1. Since the ends of the spray-deposited layer 12 are projecting from the end faces of the finished product in the illustrated embodiment, the projecting end portions of the layer 12 are cut away by shearing or milling operation (see FIG. 2(E)).

It is preferable that the finished product is subjected to a post-heating treatment in order to increase the bonding force between the spray-deposited layer 12 and the cast metal layer. In case where the spray-deposited layer 12 is a multi-plied layer made of plural metallic materials, the physical and chemical properties of the combined metal layer can be improved by alloying the different metals at the interface thereof by this post-heating operation.

Figure 3:
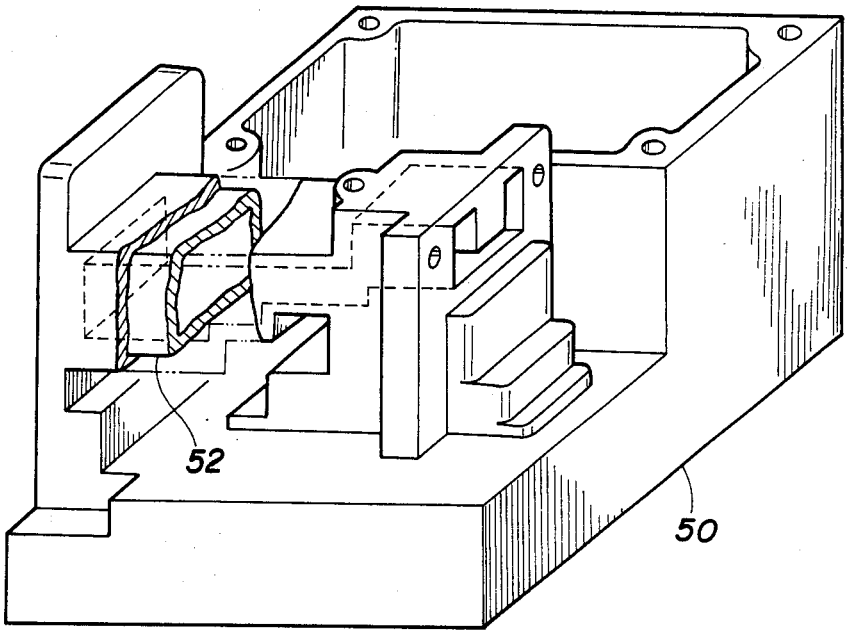
FIG. 3 is a perspective view, with portions broken away, of a cast product produced according to this invention.

A portion of a product produced in accordance with the process of the invention is shown in FIG. 3. The product shown in FIG. 3 is a casing 50 for an electronic device having therein a spray-deposited layer 52 serving as a wave guide tube. This casing 50 is produced, generally following to the sequential steps shown in FIG. 1, by initially spray-depositing an electrically conductive metal to form the layer 52 having a generally rectangular and stepped section and then casting an aluminium alloy over the layer 52 by a lost wax casting process. The casing 52 having a relatively complex shape and a portion made of a different material as that forming the remaining portion may be easily produced by the application of the process of this invention.

What is claimed is:

1. A process for producing a hollow metal cast product comprising the steps of preparing a first lost model having an outer contour substantially corresponding to a desired interior contour of the finished product, depositing a molten metal or alloy over the surface of said first lost model by spraying to form a metal layer defining a hollow core block, placing said hollow core block in a first mold, pouring or injecting a material for forming a second lost model into said first mold to form a second lost model layer, coating a refractory material over said second lost model layer to form a second mold for casting, removing said second lost model to form a cavity, casting a molten metal or alloy into said cavity, and staving said second mold to take out a finished product.

2. The process according to claim 1, wherein two or more different metals or alloys are deposited concurrently to form said metal layer defining said hollow core block.

3. The process according to claim 1, wherein two or more different metals or alloys are deposited one after another to form a multi-layered metal layer defining said hollow core block.

4. The process according to claim 1, wherein said first lost model is electrically conductive, and wherein an electric potential is applied between said conductive first lost model and a spray gun for electrodepositing said molten metal at the step of depositing a molten metal or alloy to form said metal layer defining said hollow core block.

5. The process according to claim 1, wherein said first lost model is composed of a wax and said second lost model is composed of a different wax having a melting point lower than that of the wax forming said first lost model.

6. The process according to claim 1, wherein said hollow core block has protruding ends or edges for ensuring precise positioning thereof in said first mold.

7. A process for producing a hollow metal cast product comprising the steps of preparing a first lost model having an outer contour substantially corresponding to a desired interior contour of the finished product, depositing a molten ceramic material over the surface of said first lost model by spraying to form a ceramic layer defining a hollow core block, placing said hollow core block in a first mold, pouring or injecting a material for forming a second lost model into said first mold to form a second lost model, coating a refractory material over said second lost model to form a second mold for casting, removing said second lost model to form a cavity, casting a molten metal or alloy into said cavity, and staving said second mold to take out a finished product.

8. The process according to claim 7, wherein two or more different ceramic materials are deposited concurrently to form said ceramic layer defining said hollow core block.

9. The process according to claim 7, wherein two or more different ceramic materials are deposited one after another to form a multi-layered ceramic layer defining said hollow core block.

10. The process according to claim 7, wherein said first lost model is electrically conductive, and wherein an electric potential is applied between said conductive first lost model and a spray gun for electrodepositing said molten ceramic material at the step of depositing a molten ceramic material to form said ceramic layer defining said hollow core block.

11. The process according to claim 7, wherein said first lost model is composed of a wax and said second lost model is composed of a different wax having a melting point lower than that of the wax forming said first lost model.

12. The process according to claim 7, wherein said hollow core block has protruding ends or edges for ensuring precise positioning thereof in said first mold.

13. A process for producing a hollow metal cast product comprising the steps of preparing a first lost model having an outer contour substantially corresponding to a desired interior contour of the finished product, depositing a metal and a ceramic material over the surface of said first lost model by spraying to form a composite layer defining a hollow core block, placing said hollow core block in a first mold, pouring or injecting a material for forming a second lost model into said first mold to form a second lost model, coating a refractory material over said second lost model to form a second mold for casting, removing said second lost model to form a cavity, casting a molten metal or alloy into said cavity, and staving said second mold to take out a finished product.

14. The process according to claim 13, wherein one or more metal and one or more ceramic material are deposited concurrently to form said layer defining said hollow core block.

15. The process according to claim 13, wherein one or more metal and one or more ceramic material are deposited one after another to form a multi-layered layer defining said hollow core block.

16. The process according to claim 13, wherein said first lost model is electrically conductive, and wherein an electric potential is applied between said conductive first lost model and a spray gun for electrodeposition of said metal and said ceramic material to form said composite layer defining said hollow core block.

17. The process according to claim 13, wherein said first lost model is electrically conductive, and wherein an electric potential is applied between said conductive first lost model and a spray gun for electrodeposition of either one of said metal or said ceramic material to form said composite layer defining said hollow core block.

18. The process according to claim 13, wherein first lost model is composed of a wax and said second lost model is composed of a different wax having a melting point lower than that of the wax forming said first lost model.

19. The process according to claim 13, wherein said hollow core block has protruding ends or edges for ensuring precise positioning thereof in said second mold.

* * * * *